US009963809B2

(12) United States Patent
Michihata et al.

(10) Patent No.: US 9,963,809 B2
(45) Date of Patent: May 8, 2018

(54) NONWOVEN FABRIC AND METHOD FOR MANUFACTURING SAME

(75) Inventors: Toyofumi Michihata, Tochigi (JP); Shigeki Takeda, Saitama (JP); Shota Inoue, Koga (JP)

(73) Assignee: JAPAN VILENE COPMANY, LTD., Tokyo (JP)

( * ) Notice: Subject to any disclaimer, the term of this patent is extended or adjusted under 35 U.S.C. 154(b) by 0 days. days.

(21) Appl. No.: 13/353,833

(22) Filed: Jan. 19, 2012

(65) Prior Publication Data

US 2012/0190261 A1 Jul. 26, 2012

(30) Foreign Application Priority Data

Jan. 21, 2011 (JP) ..... 2011-010325

(51) Int. Cl.
*D04H 1/50* (2012.01)
*D04H 1/498* (2012.01)
(Continued)

(52) U.S. Cl.
CPC ..... *D04H 1/50* (2013.01); *D04H 1/4382* (2013.01); *D04H 1/482* (2013.01); *D04H 1/492* (2013.01);
(Continued)

(58) Field of Classification Search
CPC D04H 1/46; D04H 1/465; D04H 1/48; D04H 1/482; D04H 1/49; D04H 1/492;
(Continued)

(56) References Cited

U.S. PATENT DOCUMENTS

2003/0124939 A1* 7/2003 Zafiroglu et al. ..... 442/352
2004/0156886 A1* 8/2004 Kose ..... A61K 9/7061 424/449
(Continued)

FOREIGN PATENT DOCUMENTS

JP 03161433 A * 7/1991
JP 08-260313 A 10/1996
(Continued)

OTHER PUBLICATIONS

Machine Translation of JP 2009-079325.*
(Continued)

*Primary Examiner* — Frank J Vineis
(74) *Attorney, Agent, or Firm* — Heslin Rothenberg Farley & Mesiti P.C.

(57) ABSTRACT

An extensible nonwoven fabric, and method for its manufacture, on which the source, medicinal component, pattern and/or other pieces of information are recognizable at the beginning of and during fabric use. It is made mainly of highly crimped fibers, with a compressed region where no fibers are melted and bonded together, with a tensile strength of 25 N/5-cm-width or more in both the machine direction and the cross direction. It may be manufactured by causing a water jet having a pressure of 5 MPa or more to act onto a web made mainly of a latent crimpable fiber, forming an entangled fiber web, causing heat to act on it, crimping the fiber converting it to a highly crimped fiber while contracting the web's area by 30% or more forming a contracted fiber web, and embossing it such that the fibers are not melted and bonded together.

3 Claims, 1 Drawing Sheet

(51) Int. Cl.
*D04H 1/482* (2012.01)
*D04H 1/492* (2012.01)
*D04H 1/74* (2006.01)
*D04H 1/4382* (2012.01)
*D04H 1/435* (2012.01)

(52) U.S. Cl.
CPC ..... *D04H 1/498* (2013.01); *D04H 1/74* (2013.01); *D04H 1/435* (2013.01); *Y10T 442/60* (2015.04)

(58) Field of Classification Search
CPC ..... D04H 1/498; D04H 1/50; D04H 1/485; D04H 1/488; D04H 1/495; D04H 3/11; D04H 5/03; D04H 18/04
USPC ..... 442/352–360, 327; 428/295.7, 298.4, 428/362, 369–371; 424/442–449
See application file for complete search history.

(56) References Cited

U.S. PATENT DOCUMENTS

2005/0181163 A1* 8/2005 Kose ..... A61K 9/7061 428/40.1
2005/0249931 A1* 11/2005 Utsumi ..... 428/218
2008/0073813 A1* 3/2008 Smith et al. ..... 264/266

FOREIGN PATENT DOCUMENTS

JP 2001-055654 * 2/2001
JP 2001-231812 8/2001
JP 2002-235269 8/2002
JP 2005-162638 A 6/2005
JP 2005-187954 7/2005
JP 2009-079325 4/2009
JP 2009079324 A * 4/2009

OTHER PUBLICATIONS

Machine Translation of JP 2002-235269.*
Machine Translation of JP 2001-055654, accessed Oct. 23, 2014.*
Kamath, M.G. Spunlace (Hydroentanglement), archived Feb. 10, 2008, http://www.engr.utk.edu/mse/Textiles/Spunlace.htm.*
Machine Translation of JP 2005-187954.*
European Search Report dated Feb. 23, 2012 for EP Application No. 12151880.7.

* cited by examiner

NONWOVEN FABRIC AND METHOD FOR MANUFACTURING SAME

TECHNICAL FIELD

The present invention relates to a nonwoven fabric having a compressed region wherein no fibers are melted and bonded to each other. More specifically, the invention relates to a nonwoven fabric wherein the compressed region as described above can be definitely recognized. The nonwoven fabric of the invention has extensibility, so that the fabric can be suitably used as: a skin patch base-material onto which an ointment containing a medicinal component is applied in order to constitute a medicinal patch for external use, a skin patch base-material onto which a cosmetic gel is applied in order to constitute a face pack, or a skin patch base-material into which a lotion is impregnated in order to constitute a face pack.

BACKGROUND ART

Conventionally, nonwoven fabrics have been applied to various articles. For example, an extensible nonwoven fabric has been favorably used for, for example, a skin patch base-material or some other article by use of the extensibility thereof. It is suggested that a nonwoven fabric which is a skin patch base-material is embossed, thereby recording the source or identifications (such as the manufacturer and the product name), a medicinal component of an ointment therein, and other pieces of information in order that the information can be understood even after the patch is taken from a package, or attaching importance to design.

For example, the applicant suggested a "stretchable nonwoven fabric having long recognizable concave units which are each a character, a figure, a pattern, a symbol, a picture, or a combination of two or more of these elements, and which are each recognizable by a matter that the unit itself is in a concave form, wherein the recognizable concave units are arranged in such a manner that a straight line consistent with the central axis of each of the units is oriented to cross any straight line parallel to the machine direction of the nonwoven fabric and any straight line parallel to the cross direction of the nonwoven fabric, and further the 50% modulus strength in the machine direction or the cross direction of the nonwoven fabric is 4 N/50-mm-width or less" (Patent Literature 1). At the beginning of the use of this stretchable nonwoven fabric, the recognizable concave units are certainly somewhat distinct or clear, so that pieces of information, such as the source, the medicinal component, and/or a design, can be gained. However, this nonwoven fabric has the following problem: when this nonwoven fabric is used as a skin patch base-material, the nonwoven fabric rubs against clothing, or something else, so that the recognizable concave units become indistinct; thus, the information, such as the source, the medicinal component and the design, becomes unable to be definitely recognized.

As another example, the following is suggested: a stretchable nonwoven fabric subjected to embossing, wherein at least two crimped conjugated fibers having melt-starting temperatures different from each other are intermingled and entangled with each other, and further fiber-intermingled/entangled regions of embossed concaves are neither melted nor bonded to each other" (Patent Literature 2). About this stretchable nonwoven fabric, the embossed concaves are rendered pieces of information, such as the source, the medicinal component, and/or a design. However, the texture of the stretchable nonwoven fabric is poor; thus, even at the beginning of the use thereof, the embossed concaves are indistinct so that the information is not precisely recognized.

As still another nonwoven fabric, the following is suggested: "a support for a medicinal patch for external use, characterized by embossing a nonwoven fabric containing a thermoplastic fiber, as a main component, and a low-melting-point fiber blended with the thermoplastic fiber, thereby engraving a character into the nonwoven fabric" (Patent Literature 3). In this support, the character is engraved by the embossing; however, as is evident from examples thereof, the low-melting-point fiber is melted and bonded. Thus, this support is not an extensible support.

Such pieces of information based on embossed concaves, such as the source, and a design, are not limited to skin patch base-materials as described above, and are problems that also occur in: a skin patch base-material onto which a cosmetic gel is to be applied in order to constitute a face pack, a skin patch base-material into which a lotion is to be impregnated in order to constitute a face pack, an interlining, and others.

CITATION LIST

Patent Literature

[Patent Literature 1] Japanese Unexamined Patent Publication (Kokai) No. 2002-235269
[Patent Literature 2] Japanese Unexamined Patent Publication (Kokai) No. 2005-187954
[Patent Literature 3] Japanese Unexamined Patent Publication (Kokai) No. 2001-231812

SUMMARY OF INVENTION

Technical Problem

Given the situation described above, the invention has been made. An object of the present invention is to provide an extensible nonwoven fabric on which pieces of information, such as the source, the medicinal component, and/or a design, are evidently recognizable not only at the beginning of use, but also during use; and a method for manufacturing the nonwoven fabric.

Solution to Problem

The invention recited in claim 1 is a "nonwoven fabric, made mainly of highly crimped fibers, partially having a compressed region where no fibers are melted and bonded to each other, and having a tensile strength of 25 N/5-cm-width or more in both the machine direction and the cross direction".

The invention recited in claim 2 is a "method for manufacturing a nonwoven fabric, including the steps of: (1) forming a fiber web made mainly of latent crimpable fibers, (2) causing a water jet having a pressure of 5 MPa or more to act onto the fiber web, thereby forming an entangled fiber web, (3) causing heat to act onto the entangled fiber web, thereby crimping the latent crimpable fibers to convert the fibers to highly crimped fibers, and contracting, at the time of the conversion, the area of the entangled fiber web by 30% or more, thereby forming a contracted fiber web, and (4) embossing the contracted fiber web in such a manner that the fibers are not melted and bonded to each other, thereby forming a nonwoven fabric partially having a compressed region, and having a tensile strength of 25 N/5-cm-width or more in both the machine direction and the cross direction".

Advantageous Effects of Invention

The invention recited in claim 1 is a nonwoven fabric which has a tensile strength of 25 N/5-cm-width or more in both the machine direction and the cross direction; the fabric is a nonwoven fabric wherein pieces of information, such as the source, the medicinal component, and/or a design, are recognizable not only at the beginning of the use of the fabric but also during use by effect of the compressed region partially contained in the nonwoven fabric, where no fibers are melted and bonded to each other. In other words, that the tensile strength is 25 N/5-cm-width or more means that the fiber density is high and that the fibers are sufficiently entangled with each other. Thus, at the beginning of the use, the compressed region is distinct, and further in both of the compressed region, and the non-compressed region, the highly crimped fibers are sufficiently entangled with each other. Therefore, even when the nonwoven fabric rubs against something, the entangled fibers are not easily disentangled, so that the distinctness of the compressed region can be maintained. As a result, the information can be evidently recognized.

Moreover, the invention recited in claim 1 is made mainly of highly crimped fibers; therefore, the invention is a nonwoven fabric with excellent extensibility.

In the invention recited in claim 2, a fiber web made mainly of latent crimpable fibers is used; therefore, a nonwoven fabric made mainly of a highly crimped fiber can be manufactured. As a result, a nonwoven fabric with excellent extensibility can be manufactured.

Additionally, the water jet, the pressure of which is 5 MPa or more, is caused to act onto the fiber web, thereby entangling the fibers sufficiently with each other; and the area of the entangled fiber web is contracted by 30% or more. By these steps, the entanglement of the fibers is enhanced so that the fiber density is increased. In this state, the fiber is embossed; thus, the manufactured nonwoven fabric has a compressed region which is distinct not only at the beginning of the use of the fiber but also during use, so that pieces of information, such as the source, the medicinal component, and/or a design, are evidently recognizable.

BRIEF DESCRIPTION OF DRAWINGS

FIG. 2(*b*) is a view illustrating the angle between a straight line drawn by linking the centers of compressed region units in the cross direction, and a straight line parallel to the cross direction of the nonwoven fabric in FIG. 1.

FIG. 2(*c*) is a view illustrating the angle between a straight line drawn by linking the centers of compressed region units in the machine direction, and a straight line parallel to the machine direction of the nonwoven fabric in FIG. 1.

DESCRIPTION OF EMBODIMENTS

Figure 1:
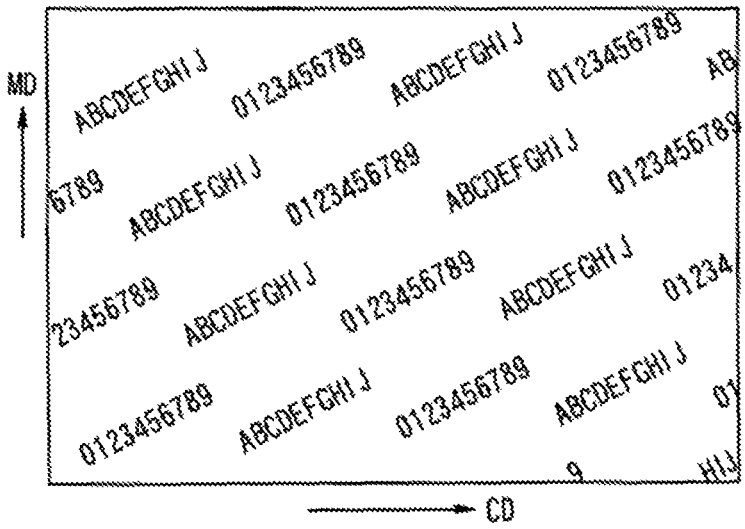
FIG. 1 is a plan view illustrating the arrangement of compressed regions in an example nonwoven fabric.

The nonwoven fabric of the invention is made mainly of highly crimped fibers to give an excellent extensibility. In the highly crimped fiber, the number of crimps is large. Thus, when an external force is applied thereto, the crimps can be stretched; therefore, the nonwoven fabric is excellent in extensibility, and further, when the external force is removed, a force returning the crimps into the original state acts. Thus, the highly crimped fiber is excellent in stretchability (=elasticity, or extensibility and contractility). For this reason, the nonwoven fabric can follow the motion of a bending region and/or unevenness.

The highly crimped fiber in the invention denotes a fiber with a number of crimps of 50 per inch, or more. This highly crimped fiber can be obtained, for example, by crimping a latent crimpable fiber. The number of crimps is a value obtained by a method prescribed in JIS L1015: 2010 8. 12. 1 "Number of Crimps".

This latent crimpable fiber is, for example, a conjugated fiber wherein resins different in thermal shrinkage are conjugated with each other, or a fiber which is partially subjected to a specified thermal hysteresis. More specifically, a fiber having an eccentric core-in-sheath structure, or a fiber having a side-by-side structure can be preferably used as the conjugated fiber. Examples of the resins different in thermal shrinkage include polyester/low-melting-point polyester, polyamide/low-melting-point polyamide, polyester/polyamide, polyester/polypropylene, polypropylene/low-melting-point polypropylene, polypropylene/polyethylene, and various other combinations of synthetic resins. Particularly preferred is a latent crimpable fiber made of a combination of polyester/low-melting-point polyester, or polypropylene/low-melting-point polypropylene since the fiber is excellent in chemical resistance, extensibility and stretchability. The fiber which is partially subjected to a specified thermal hysteresis is, for example, obtained by passing a fiber made of a thermoplastic resin such as polyester or polyamide while a single side of the fiber is brought into contact with a heated blade, or some other device.

The fineness of this latent crimpable fiber is not particularly limited, and is preferably 5 dtex or less, more preferably 3 dtex or less, even more preferably 2.5 dtex or less, and even more preferably 2.2 dtex or less in order that the fibers may easily be entangled with each other and the contact between fibers is high so that a distinct compressed region can be formed. There is no particular lower limit of the fineness. When the fiber is formed into a fiber web through a dry process, the fineness is preferably 0.5 dtex or more, more preferably 0.8 dtex or more in order that the texture of the formed fiber web may be made even so that a distinct compressed region can be formed.

The fiber web may contain two or more latent crimpable fibers differing in fineness. When the fiber web contains two or more latent crimpable fibers differing in fineness in this way, the average fineness calculated according to an equation described below is preferably in the above-mentioned range. When the fiber web contains three or more latent crimpable fibers differing in fineness, the value calculated in the same way is preferably in the above-mentioned range.

$$Fav=1/\{(Pa/100)/Fa+(Pb/100)/Fb\}$$

wherein Fav represents the average fineness (unit: dtex); Pa the proportion by mass (unit: mass %) of one of the two fibers (fiber A) occupying the fiber web; Fa the fineness (unit: dtex) of the fiber A; Pb the proportion by mass (unit: mass %) of the other fiber (fiber B) occupying the fiber web; Fb the fineness (unit: dtex) of the fiber B.

The fiber length of the latent crimpable fiber is not particularly limited, and is preferably 110 mm or less, more preferably 64 mm or less, even more preferably 51 mm or less to permit the fibers to be easily entangled with each other. There is no particular lower limit of the fiber length. When the fiber is formed into a fiber web through a dry process, the fiber length is preferably 25 mm or more, more preferably 30 mm or more in order that this formed fiber web may have an even texture so that a distinct compressed region can be formed.

The nonwoven fabric of the invention is made mainly of a highly crimped fiber as described above. In the invention, the wording "made mainly of" means that the nonwoven fabric contains 50 mass % or more of the highly crimped fiber. The higher the proportion of the highly crimped fiber, the better the extensibility and the stretchability. Additionally, the highly crimped fibers of the nonwoven fabric are better entangled with each other in both its compressed region and its non-compressed region; thus, even when the nonwoven fabric rubs against something during use, the entangled fibers tend to be less easily disentangled so that the information based on the compressed region is distinct. Thus, the highly crimped fiber is contained in a proportion preferably in the range of 70 mass % or more, more preferably 90 mass % or more. Most preferably, the nonwoven fabric is made of 100% of the highly crimped fiber.

The types of fiber(s) other than the highly crimped fiber is/are not particularly limited. When the highly crimped fiber is a fiber obtained by crimping a latent crimpable fiber, the other fiber(s) is/are (a) fiber(s) that is not melted by effect of heat used when the latent crimpable fiber is crimped, so as not to damage the extensibility and the stretchability of the nonwoven fabric. Examples of the fiber include polyester based fibers (such as polyethylene terephthalate fiber, polybutylene terephthalate fiber, and polytrimethylene terephthalate fiber), polyolefin based fibers (such as polyethylene fiber, and polypropylene fiber), polyamide based fibers (such as 6 nylon fiber, and 66 nylon fiber), polyvinyl alcohol fiber, acrylic fiber, and other synthetic fibers; and cellulose fibers such as cotton and rayon.

The fiber(s) constituting the nonwoven fabric of the invention, such as the highly crimped fiber, may be white, or may include a fiber colored with a pigment and/or dyed with a dye into a color other than white. When the nonwoven fabric includes the colored or dyed fiber, the color difference between the compressed region and the non-compressed region becomes larger. Thus, the nonwoven fabric produces the advantageous effect that the compressed region can be more evidently recognized.

As described above, the nonwoven fabric of the invention is made mainly of the highly crimped fiber, and further the fabric has a tensile strength of 25 N/5-cm-width or more in both the machine direction and the cross direction. That the tensile strength is large as described herein denotes that the nonwoven fabric's fibers are sufficiently entangled with each other so that the fiber density is high. Thus, at the beginning of the use thereof, the compressed region is distinct. Additionally, in both of the compressed region and the non-compressed region, the highly crimped fibers are sufficiently entangled with each other. Thus, even when the nonwoven fabric rubs against something, the entangled fibers are not easily disentangled. For this reason, the nonwoven fabric retains the distinctness of the compressed region even during use so that pieces of information, such as the source, the medicinal component, and/or a design, can be evidently recognized. As will be described later, in the compressed region, no fibers are melted and bonded to each other, so the region does not contribute to an improvement in the tensile strength of the nonwoven fabric. Thus, even the fiber web wherein the compressed region is not yet formed has a tensile strength of 25 N/5-cm-width or more in both the machine direction and the cross direction. The specified tensile strength is that of the nonwoven fabric; however, at the stage of the fiber web, where the compressed region is not yet formed, the fibers are already sufficiently entangled with each other. In this state, the fiber web is high in fiber density. In this fiber web, the compressed region is formed so that the compressed region is distinct not only at the beginning of the use but also during use. Such a sufficient entanglement of the fibers can be attained by hydroentangling.

When the tensile strength is higher, the fibers are more satisfactorily entangled with each other so that the fiber density is higher. As a result, at the beginning of the use and during use, the compressed region is more distinct. Thus, in both the machine direction and the cross direction, the tensile strength is preferably 25 N/5-cm-width or more, more preferably 30 N/5-cm-width or more, even more preferably 35 N/5-cm-width or more, even more preferably 40 N/5-cm-width or more, even more preferably 45 N/5-cm-width or more, and even more preferably 50 N/5-cm-width or more. At the time of the manufacture of the nonwoven fabric, the fiber is easily oriented in the machine direction; thus, the tensile strength in the machine direction tends to be larger. Specifically, the tensile strength in the machine direction is 55 N/5-cm-width or more, preferably 60 N/5-cm-width or more, more preferably 65 N/5-cm-width or more, even more preferably 70 N/5-cm-width or more, even more preferably 80 N/5-cm-width or more, even more preferably 100 N/5-cm-width or more, and even more preferably 120 N/5-cm-width or more. The upper limit of the tensile strength is not particularly limited; in both the machine direction and the cross direction, the tensile strength is actually 200 N/5-cm-width or less.

In the invention, the "tensile strength" is defined as follows: from any nonwoven fabric, specimens each having a width of 50 mm and a length of 300 mm are collected, and then using a constant-speed extending type tensile tester (TENSILON, manufactured by Orientec Co., Ltd.), in a period up to a time when each of the specimens is broken, the maximum load (applied thereto) is measured; this measurement of the maximum load is made on three of each type of specimen; the resultant maximum loads are arithmetically averaged; and the average is defined as the tensile strength. The measurement is made under conditions that the length of each of the specimens between the grips is set to 200 mm, and the tensile speed is set to 500 m/minute. In the invention, the "machine direction" denotes, the direction of movement of the nonwoven fabric during manufacture; the "cross direction", a direction orthogonal to the machine direction.

The nonwoven fabric of the invention partially has a compressed region where no fibers are melted and bonded to each other, thereby making it possible to supply a user with pieces of information, such as the source, the medicinal component, and/or a design. As described above, the nonwoven fabric of the invention is in the state that the fibers are sufficiently entangled with each other to be high in fiber density so that the compressed region is distinct at the beginning of the use; and further in both of the compressed region and the non-compressed region, the highly crimped fibers are sufficiently entangled with each other. Thus, even when the nonwoven fabric rubs against something during use, the entangled fibers are not easily disentangled. As a result, also during use, the distinctness of the compressed region can be retained, so that the information is evidently recognizable.

In the compressed region, the contact between fibers is higher than in other regions; however, no fibers are melted and bonded to each other. For this reason, the presence of the compressed region does not remove the extensibility or the stretchability of the nonwoven fabric. In other words, when the nonwoven fabric is extended by external force, the fibers constituting the compressed region (in particular, the highly crimped fibers) can also be extended. Thus, the nonwoven fabric has excellent extensibility and stretchability. There is therefore no large difference in extensibility or stretchability between the nonwoven fabric having the compressed region and the fiber web where the compressed region is not yet formed. The wording "no fibers are melted and bonded to each other" herein denotes a state in which fibers are not partially melted so that the fibers are solidified so as to be bonded to each other, but that the freedom of fibers is retained.

Each of the compressed regions may be of various forms in accordance with the purpose of the use. The compressed region may be in the form of a character, a figure, a pattern, a symbol, a picture or any other shape. Compressed regions that are in different forms may be present and mixed with each other.

The nonwoven fabric of the invention partially has compressed region(s), whereby various pieces of information can be recognized. The state of the arrangement thereof is not particularly limited. For example, the compressed regions may be regularly arranged, or irregularly arranged. As disclosed in Japanese Unexamined Patent Publication No. 2002-235269, the compressed regions are preferably arranged as follows: (1) the arrangement is attained in such a manner that a straight line consistent with the central axis of the compressed region units (the central axis of recognizable concave units in Japanese Unexamined Patent Publication No. 2002-235269, that is, a straight line parallel to the long sides of the smallest one out of rectangles each making it possible to completely surround long recurring units, such as characters, recognizable by a matter that the units are the compressed regions, this parallel straight being passed on the intersection of the diagonal lines of the smallest rectangle) crosses both a straight line parallel to the machine direction of the nonwoven fabric, and the cross direction thereof; (2) the arrangement is attained in such a manner that a straight line drawn by joining the center of any one of the compressed region units (the intersection of the diagonal lines of the smallest one out of rectangles each making it possible to completely surround long recurring units, such as characters, recognizable by a matter that the units are the compressed regions) with the center of the compressed region unit nearest to the initial compressed region unit in the cross direction of the nonwoven fabric crosses a straight line parallel to the cross direction of the nonwoven fabric; and (3) the arrangement is attained in such a manner that a straight line drawn by joining the center of any one of the compressed region units with the center of the compressed region unit nearest to the initial compressed region unit in the machine direction of the nonwoven fabric crosses a straight line parallel to the machine direction of the nonwoven fabric. Preferably, two or more of these requirements (1) to (3) should be satisfied; and more preferably, all three should be satisfied.

If the total area of the compressed region(s) is too large, the extensibility and the stretchability are easily reduced. Thus, the total area of the compressed region(s) is preferably 40% or less of the area of the nonwoven fabric, more preferably 20% or less thereof, even more preferably 10% or less thereof. On the other hand, if the total area of the compressed region(s) is too small, for example, if characters therein are too small, the target information, such as the source, the medicinal component, and/or a design, are not evidently recognized with ease. Thus, the total area of the compressed region(s) is preferably 5% or more of the area of the nonwoven fabric.

The mass per unit area of the nonwoven fabric of the invention is not particularly limited, and is preferably 30 $g/m^2$ or more, more preferably 40 $g/m^2$ to permit the fiber density to be high. Although the mass per unit area is made high to make it possible to heighten the fiber density of the compressed region(s) so that the distinctness of the compressed region(s) is improved, if the mass per unit area is too high it becomes difficult to entangle the fibers sufficiently with each other and so the compressed region(s) tend(s) to become unable to keep distinct during use. Thus, the mass per unit area is preferably 150 $g/m^2$ or less, more preferably 130 $g/m^2$ or less, and even more preferably 110 $g/m^2$ or less. The mass per unit area is a mass per square meter, and is a value obtained by a method prescribed in JIS L 1085: 1998 6.2 "Mass per Unit Area".

The thickness of the nonwoven fabric of the invention is not particularly limited. However, if the thickness is too small, the depth of the compressed region(s) can easily become insufficient to make the compressed region(s) distinct with ease. Additionally, the extensibility and the stretchability of the nonwoven fabric tend to be damaged. Thus, the thickness is preferably 0.3 mm or more, and more preferably 0.4 mm or more. On the other hand, if the thickness is too large, the nonwoven fabric is liable to be in a state that the fibers are not sufficiently entangled with each other. Thus, during use, the compressed region(s) tend(s) to become indistinct. Thus, the thickness is preferably 1.5 mm or less, more preferably 1 mm or less, even more preferably 0.85 mm or less. The "thickness" is a value measured by use of a textile pressure elasticity tester under the following conditions: a contact area of 5 $cm^2$, and a load of 0.98 N (100 gf).

As described above, the nonwoven fabric of the invention is easily extended. Specifically, the extension coefficient (elongation percentage) is preferably 100% or more in both the machine direction and the cross direction, and is more preferably 120% or more in both the two directions. At the time of the manufacture of the nonwoven fabric, the fibers used therefor are easily oriented, particularly, in the machine direction; thus, preferably, the nonwoven fabric should easily be extended in the cross direction. Specifically, the extension coefficient in the cross direction is preferably 150% or more, more preferably 180% or more, even more preferably 190% or more, even more preferably 200% or more. This extension coefficient is the following percentage obtained when the tensile strength is measured: the percentage of the length of the extension of the specimen at the time of the application of the maximum load [=(the length of the specimen at the time of the application of the maximum load; unit: mm)−(the length of the specimen between the grips=200 mm)] to the length (200 mm) between the grips. This measurement is made three times, and the resultant percentages are arithmetically averaged. The result is defined as the extension coefficient.

In order that the nonwoven fabric of the invention can have an excellent extensibility, the 50% modulus strength in the cross direction is preferably 8 N/5-cm or less, more preferably 6 N/5-cm or less, even more preferably 5 N/5-cm or less, and even more preferably 4 N/5-cm or less. In order that the compressed region(s) can be stably formed, the 50% modulus strength in the machine direction is preferably 5 N/5-cm or more.

This 50% modulus strength is defined as follows: from any nonwoven fabric, specimens each having a width of 50 mm and a length of 300 mm are collected; a constant-speed extending type tensile tester (TENSILON, manufactured by Orientec Co., Ltd.) is used, and each of the specimens is fixed thereto with the length of the specimen between grips set to 200 mm; in a period up to a time when the specimen is extended by 100 mm (the distance between the grips: 300 mm), the maximum load (applied thereto) is measured; this measurement of the maximum load is made about three of the specimens; the resultant maximum loads are arithmetically averaged; and the average is defined as the 50% modulus strength. The measurement is made under the condition that the tensile speed is set to 500 m/minute.

The nonwoven fabric of the invention is excellent in stretchability. Specifically, when the nonwoven fabric is extended by 50%, the recovery ratio is preferably 40% or more, and more preferably 45% or more in both the machine direction and the cross direction. In particular, in the cross direction, along which the extensibility percentage is high so that the nonwoven fabric structure is not easily broken, the recovery ratio is preferably 50% or more, more preferably 55% or more, even more preferably 60% or more, even more preferably 65% or more.

The recovery ratio when any nonwoven fabric is extended by 50% is defined as follows: from the nonwoven fabric, specimens each having a width of 50 mm and a length of 300 mm are collected; a constant-speed extending type tensile tester (TENSILON, manufactured by Orientec Co., Ltd.) is used, and each of the specimens is fixed thereto with the length of the specimen between grips set to 200 mm; the (grip) position where the distance between the grips is 200 mm is defined as a starting point; from the starting point to the (grip) position where the distance between the grips is extended by 100 mm, that is, the 50% extended position ($L_{50}$=100 mm), the specimen is strained at a speed of 200 mm/min.; immediately the grip position is returned to the starting point at the same speed; in this case, the distance ($L_n$) from the starting point to the (grip) position when the tensile stress of the specimen drops to zero is measured; this measurement is made on three of the specimens; the distances ($L_n$) are arithmetically averaged; and then a numerical value calculated from the following equation is defined as the recovery ratio when the nonwoven fabric is extended by 50%:

$$\text{Recovery ratio (\%) when the nonwoven fabric is extended by 50\%} = [(L_{50} - L_n)/L_{50}] \times 100 = 100 - L_n$$

The nonwoven fabric of the invention is preferably a nonwoven fabric wherein fibers are sufficiently entangled with each other to be high in fiber density, and further the fibers are evenly dispersed to give an excellent texture. Its compressed region(s) is/are far more distinct at the beginning of the use thereof, and during use. More specifically, the average texture index, as defined below, is preferably 0.55 or less, more preferably 0.50 or less, even more preferably 0.45 or less, even more preferably 0.40 or less, and even more preferably 0.35 or less.

The average texture index is a value obtained by the method described in Japanese Unexamined Patent Publication No. 2001-50902. In other words, the index is a value obtained as follows:

(1) From a light source, light rays are radiated onto an arbitrary place of an object to be measured. Out of the radiated light rays, light rays reflected from a predetermined area on the object to be measured are received by means of a light-receiving element so that luminance data are gained.

(2) The predetermined area of the object to be measured is equally divided into sections each having an image size of 3 mm square, an image size of 6 mm square, an image size of 12 mm square, and an image size of 24 mm square. In this way, four division patterns are gained.

(3) For each of the resulting division patterns, the luminance value of each of the sections, which have been equally divided, is calculated on the basis of the luminance data.

(4) For each of the division patterns, the average luminance (X) is calculated on the basis of the respective luminance values of the individual sections.

(5) For each of the division patterns, the standard deviation (σ) is gained.

(6) For each of the division patterns, the coefficient of the variation (CV) is calculated according to the following definition:

Coefficient of the variation (CV)=(σ/X)×100 wherein σ represents the standard deviation about each of the division patterns, and X represents the average luminance thereabout.

(7) The logarithms of the individual image sizes are plotted on the X-coordinate, and the coefficients of the variation that correspond to the image sizes are plotted on the Y-coordinate. The coordinate groups obtained as a result of the plotting are regressed onto a linear line by the method of least squares. The inclination thereof is then calculated. The absolute value of this inclination is defined as the texture index.

(8) The measurement of the texture index is repeated three times. The average thereof is defined as the average texture index.

The method for manufacturing the nonwoven fabric of the invention is not particularly limited. The nonwoven fabric may be manufactured through the steps of, for example: (1) forming a fiber web made mainly of a latent crimpable fiber, (2) causing a water jet having a pressure of 5 MPa or more to act onto the fiber web, thereby forming an entangled fiber web, (3) causing heat to act onto the entangled fiber web, thereby crimping the latent crimpable fiber to convert the fiber into a highly crimped fiber, and contracting, at the time of the conversion, the area of the entangled fiber web by 30% or more, thereby forming a contracted fiber web, and (4) embossing the contracted fiber web in such a manner that the fibers are not melted and bonded to each other, thereby forming a nonwoven fabric, partially having a compressed region, and having a tensile strength of 25 N/5-cm-width or more in both the machine direction and the cross direction. Since the fiber web made mainly of the latent crimpable fiber is used in this way, a nonwoven fabric made mainly of the highly crimped fiber can be manufactured. As a result, a nonwoven fabric excellent in extensibility and stretchability can be manufactured. Moreover, the water jet, the pressure of which is 5 MPa or more, is caused to act onto the fiber web, thereby entangling the fibers sufficiently with each other; and the area of the entangled fiber web is contracted by 30% or more. By these actions, the entanglement of the fibers is enhanced so that the fiber density is made high. In this state, the fiber is embossed; thus, the manufactured nonwoven fabric can be a nonwoven fabric the compressed region of which is distinct not only at the beginning of the use of the nonwoven fabric but also during use, so that pieces of information, such as the source, the medicinal component, and/or a design, are definitely recognizable.

More specifically, step (1) of forming a fiber web made mainly of a latent crimpable fiber (in a proportion of 50 mass % or more) can be attained by, for example, a dry method such as the card method, or the air-laying method, a wet method, or a direct method such as spunbonding. In order that the nonwoven fabric to be obtained can partially have a compressed region, whereby pieces of information are recognizable, it is preferred that the nonwoven fabric has a certain thickness. Thus, it is preferred to form the fiber web by a dry method, in particular, the card method, by which a relatively bulky fiber web is easily formed. The fiber web may be a parallel web in which fibers are oriented in the same direction, or a cross-laid web in which fibers are intersected with each other. The fiber web(s) may be overlapped. For example, a parallel web(s) may be laminated onto a cross-laid web(s) to form a crisscross web. The latent crimpable fiber may be above-mentioned latent crimpable fiber. In the next entangling step, a strong water jet is caused to act onto the web; thus, the texture of the fiber web is liable to become poor by the water jet. It is therefore preferred that the mass per unit area of the fiber web is 30 g/m$^2$ or more before the entanglement based on the water jet.

Next, in step (2) a water jet having a pressure of 5 MPa or more is caused to act onto the fiber web, thereby forming an entangled fiber web. The action of the pressurized water jet causes the fibers in the fiber web to be sufficiently entangled with each other and to be high in fiber density. As a result, pieces of information based on the compressed region become easily recognizable. A high pressure of the water jet is more suitable. Thus, a water jet having a pressure of 5.5 MPa or more is preferred. If the pressure of the water jet is too strong, the latent crimpable fiber is insufficiently crimped, giving tendencies that the extensibility and the stretchability become poor, and the texture of the entangled fiber web is poor so that the distinctness of the compressed region is deteriorated. Thus, the pressure of the water jet is preferably 12 MPa or less.

It is preferred to cause such a water jet to act not once but two or more times. As the number of times of the action of the water jet is increased, the entanglement of the fibers advances further so that the nonwoven fabric turns more easily into the state of being high in fiber density. However, if the entanglement of the fibers is excessive, the latent crimpable fiber in the next step tends not to be sufficiently crimped. Thus, it is preferred to cause the water jet to act 4 or fewer times. When the water jet is caused to act two or more times in this way, at least one time a pressure of 5 MPa or more needs to be applied. Preferably, the water jet, the pressure of which is 5 MPa or more, is caused to act two or more times in order that the nonwoven fabric may easily turn into the state of being high in fiber density. When such a water jet is caused to act, in particular, two or more times, it is preferred to cause the water jet to act onto both surfaces of the fiber web in order to entangle the fibers sufficiently with each other. It is more preferred to cause a water jet having a pressure of 5 MPa or more to act onto both surfaces of the fiber web to entangle the fibers sufficiently with each other.

When a strong water jet is caused to act in this way, the texture of the entangled fiber web tends to be disturbed so that the information based on the compressed region tend not to be easily recognizable. Thus, in order to improve the affinity between the water and the fiber web, it is preferred that before the water jet is caused to act, the fiber web is wetted by a shower or some other method, and subsequently the water pressure is gradually raised, until the water jet having a pressure of 5 MPa or more is finally caused to act.

Furthermore, the support for the fiber web used in the entanglement with the water jet is preferably a plain weave or twill weave net or a mesh screen made of a plastic or a metal and having a mesh of 50 to 100, in order not to disturb the texture of the nonwoven fabric.

Subsequently, in step (3) heat is caused to act onto the entangled fiber web, thereby crimping the latent crimpable fiber to convert the fiber to a highly crimped fiber, and at the time of the conversion the area of the entangled fiber web is contracted by 30% or more, thereby forming a contracted fiber web. Using the crimp-forming power of the latent crimpable fiber in this way, the entangled fiber web is sufficiently contracted, whereby the fiber web becomes far better in extensibility, stretchability, and other properties, and the fibers become sufficiently entangled with each other to be high in fiber density. Thus, at the beginning of the use and during use, the information based on the compressed region become easily recognizable. For this reason, the shrinkage is preferably 35% or more, more preferably 40% or more. The wording "the area is contracted by 30% or more" means, for example, that heat is caused to act onto an entangled fiber web having an area of 1 m$^2$ to form a contracted fiber web having an area of 0.7 m$^2$ or less. The contraction can be attained only in the machine direction of the entangled fiber web (the direction of the moving of the nonwoven fabric at the time of manufacture), can be attained only in the cross direction of the entangled fiber web (a direction orthogonal to the machine direction), or can be attained in both the machine direction and the cross direction of the entangled fiber web. Considering the tensile strength, the extensibility and the stretchability of the nonwoven fabric, and/or the distinctness of the compressed region, it is preferred to contract the entangled fiber web in both the machine direction and the cross direction. In order to contract the web in both the directions in this way, for example, the web may be overfed in the machine direction while heat may be caused to act onto the web in a way such that the contraction in the cross direction is not impaired. The heat for contracting the area of the entangled fiber web by 30% or more may be caused to act onto the entangled fiber web while the web is transported on a conveyer.

The heat caused to act onto the entangled fiber web needs only to crimp the latent crimpable fiber to have 50 crimps or more per inch. Since the temperature therefor is varied in accordance with the species of the latent crimpable fiber, the heat is not particularly limited. This temperature may be appropriately set through experiments in accordance with the latent crimpable fiber species. The means for the heating is not particularly limited, and may be, for example, a hot air dryer, an infrared lamp, a heating roll, or some other means. Among these means, a heating means that does not give a strong pressure through its solid member is preferred, such as a hot air dryer or an infrared lamp, and so does not easily hinder the entangling effects of the latent crimpable fibers when the fibers are crimped.

(4) The contracted fiber web is embossed in such a manner that the fibers are not melted and bonded to each other, thereby forming a nonwoven fabric partially having a compressed region, and having a tensile strength of 25 N/5-cm-width or more in both the machine direction and the cross direction. According to the invention, in the entangled fiber web forming step and the contracted fiber web forming step, a contracted fiber web is formed, wherein the fibers are sufficiently entangled with each other to be high in fiber density, and subsequently a compressed region is formed; therefore, the manufactured nonwoven fabric can be a nonwoven fabric wherein the information based on the compressed region are evidently recognizable at the beginning of the use and during use.

It is important to conduct the embossing so as not to melt the fibers and cause them to be bonded to each other. If the fibers are melted and bonded to each other, the nonwoven fabric cannot exhibit sufficient extensibility or stretchability. In order not to melt the fibers and bond them to each other, the temperature of a machine for the embossing is set to a temperature lower than the melting point of the following resin component: the resin component having the lowest melting point of the fiber(s) constituting the contracted fiber web. The temperature is set preferably to a temperature lower than the melting point by 30° C. or more, more preferably to a temperature lower than the melting point by 50° C. or more. On the other hand, for the distinctness of the compressed region at the beginning of the use and during use, or in order that the volume of the compressed region may not be restored by any heating treatment when the nonwoven fabric is stored or subjected to post-treatment, it is preferred to conduct the embossing at a temperature higher than the glass transition temperature of the following resin component: the resin component having the highest glass transition temperature of the fiber(s) constituting the contracted fiber web. When the resin component having the highest glass transition temperature is a polyester based resin out of the fiber(s) constituting the contracted fiber web, the embossing is conducted preferably at 100° C. or higher, more preferably at 120° C. or higher, even more preferably at 140° C. or higher, even more preferably 160° C. or higher.

The embossing machine may be, for example, a combination of a smoothing roll with an embossing roll, or a combination of paired embossing rolls synchronized with each other. Examples of the material of the smoothing roll include steel, cotton, wool, and heat resistant resin. From the viewpoint of forming the compressed region distinctly, and the viewpoint of contamination, it is preferred to use a smoothing roll made of heat resistant resin. Preferred examples of the heat resistant resin include polyamide. The Shore D hardness thereof is preferably about 80. The material of the embossing roll may be metal or heat resistant material. From the viewpoint of forming the compressed region distinctly, it is preferred to use an embossing roll made of metal. Thus, particularly preferred is a combination of a smoothing roll made of heat resistant resin with an embossing roll made of metal. In order to compress the fiber web partially by this embossing machine to form the compressed region, from which the information, such as the source, the medicinal component, and/or a design, are recognizable, the embossing roll or the like has a convex portion having a mirror image corresponding to the compressed region.

The embossing machine may be caused to act, without being heated, onto the contracted fiber web that still retains heat just after the web is formed, or may be caused to act, with being heated, onto the contracted fiber web that no longer retains heat, which is in a stable state. The pressure applied to the contacted fiber web by the embossing machine is varied in accordance with the species of the embossing machine, the speed of the embossing, the embossing temperature, the area of the compressed region, the width of the contracted fiber web, the species or state of the web, and other factors. Thus, the pressure is appropriately adjusted to make the compressed region distinct.

The nonwoven fabric formed by the nonwoven fabric forming step has a tensile strength of 25 N/5-cm-width or more in both the machine direction and the cross direction. As described above, however, the fibers are not melted and bonded to each other by the embossing. Thus, the nonwoven fabric is not improved in tensile strength by the embossing. In other words, the contracted fiber web itself is in the state that the fibers are sufficiently entangled with each other to be high in fiber density by the effect of the water jet and the contracting effect; thus, in both the machine direction and the cross direction, the contracted fiber web has a tensile strength of 25 N/5-cm-width or more.

The above-mentioned method is a basic method for manufacturing the nonwoven fabric of the invention. When the nonwoven fabric does not contain any colored or dyed fiber, a more distinct compressed region based on the embossing can be formed by dyeing, after the formation of the entangled fiber web or after the formation of the contracted fiber web.

EXAMPLES

The present invention now will be further illustrated by, but is by no means limited to, the following Examples.

Example 1

The following fibers were used in a proportion of 100 mass %: side-by-side type latent crimpable fibers (fineness: 2.2 dtex; and fiber length: 51 mm) composed of a polyester (melting point: 250° C.) and a low-melting-point polyester (melting point: 230° C.). A carding machine was used to open the fibers. Next, a cross lapper was used to form a cross-laid web (mass per unit area: 60 g/m$^2$). Thereafter, a twill weave net support made of polyester and having a mesh of 90 was used to transport the web while the fibers were entangled with each other by a water jet. In this way, a hydroentangled fiber web was formed. Conditions for the hydroentangling were as follows:

1. Shower: 0.1 MPa onto a single surface of the web, which will be referred to as the surface A
2. 5.5 MPa onto the surface A from a nozzle plate having a nozzle diameter of 0.13 mm, and a nozzle pitch of 0.6 mm
3. 5.5 MPa onto the surface reverse to the surface A, which will be referred to as the surface B hereinafter from a nozzle plate having a nozzle diameter of 0.13 mm, and a nozzle pitch of 0.6 mm Next, the hydroentangled fiber web was dried at 110° C. Thereafter, while the web was overfed in the machine direction without being regulated in the cross direction, the web was transported on a conveyer. This hydroentangled fiber web, while being transported, was subjected to heating treatment at a temperature of 180° C. with a hot air dryer. In this way, the latent crimpable fibers were crimped to form highly crimped fibers. At the time of the formation, the area of the hydroentangled fiber web was contracted by 40% in total in the machine direction and the cross direction to form a contracted fiber web having a mass per unit area of 100 g/m$^2$.

This stable contracted fiber web, which no longer retained heat, was passed into the gap of an embossing machine (linear pressure: 30 kg/cm) composed of a smoothing roll made of a heat resistant resin (component: polyamide, Shore D hardness: 83) and an embossing roll (temperature: 160° C.) made of a metal to manufacture a nonwoven fabric partially having compressed regions. In the compressed regions of this nonwoven fabric, no fibers were melted and bonded to each other. The compressed regions were as follows:

Compressed region units: units "ABCDEFGHIJ", and units "0123456789" (see FIG. 1)

Figure 2:
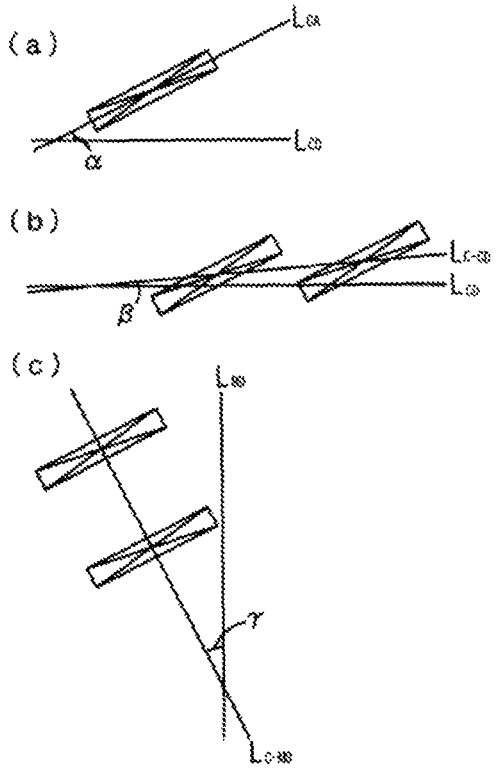
FIG. 2(*a*) is a view illustrating the angle between a straight line consistent with the central axis of any one of the compressed region units, and a straight line parallel to the cross direction of the nonwoven fabric in FIG. 1.

Arrangement:

(1) angle (α) between a straight line $L_{CA}$ consistent with the central axis of any one of the compressed region units and a straight line $L_{CD}$ parallel to the cross direction of the nonwoven fabric (see FIG. 2(*a*)): 27° with respect to any one of the compressed regions, (2) angle (β) between a straight line $L_{C\text{-}CD}$ drawn by linking the center of any one of the compressed region units with the center of the compressed region unit nearest in the cross direction of the nonwoven fabric to the first compressed region, and the straight line $L_{CD}$ parallel to the cross direction of the nonwoven fabric (see FIG. 2(*b*)): 5° with respect to any combination (of the compressed regions having this relationship), and (3) angle (γ) between a straight line $L_{C\text{-}MD}$ drawn by linking the center of any one of the compressed region units with the center of the compressed region unit nearest in the machine direction of the nonwoven fabric to the first compressed region, and a straight line $L_{MD}$ parallel to the machine direction of the nonwoven fabric (see FIG. 2(*c*)): 27° with respect to any combination (of the compressed regions having this relationship).

Total area of the compressed regions: 8%

Example 2

A nonwoven fabric was manufactured in the same way as in Example 1 except that the hydroentangling conditions were changed as described below, the temperature of the hot air dryer was set to 185° C. when the latent crimpable fibers were crimped to form the highly crimped fibers, and the area of the hydroentangled fiber web was contracted by 35% in total in the machine direction and the cross direction. In the compressed regions of this nonwoven fabric, no fibers were melted and bonded to each other.

1. Shower: 0.1 MPa onto the surface A
2. 4.0 MPa onto the surface A from a nozzle plate having a nozzle diameter of 0.13 mm, and a nozzle pitch of 0.6 mm
3. 5.5 MPa onto the surface B from a nozzle plate having a nozzle diameter of 0.13 mm, and a nozzle pitch of 0.6 mm

Example 3

A nonwoven fabric was manufactured in the same way as in Example 1 except that the hydroentangling conditions were changed as described below, the temperature of the hot air dryer was set to 185° C. when the latent crimpable fibers were crimped to form the highly crimped fibers, and the area of the hydroentangled fiber web was contracted by 45%. In the compressed regions of this nonwoven fabric, no fibers were melted and bonded to each other.

1. Shower: 0.1 MPa onto the surface A
2. 4.0 MPa onto the surface A from a nozzle plate having a nozzle diameter of 0.13 mm, and a nozzle pitch of 0.6 mm
3. 5.0 MPa onto the surface B from a nozzle plate having a nozzle diameter of 0.13 mm, and a nozzle pitch of 0.6 mm

Example 4

The following fibers were used in a proportion of 100 mass %: eccentric core-in-sheath type latent crimpable fibers (fineness: 2.2 dtex; and fiber length: 44 mm) composed of a polypropylene (melting point: 159° C.) and a low-melting-point polypropylene (melting point: 119° C.). A carding machine was used to open the fibers. Next, a cross lapper was used to form a cross-laid web (mass per unit area: 50 g/m$^2$). Thereafter, a twill weave net support made of polyester and having a mesh of 90 was used to transport the web while the fibers were entangled with each other by a water jet. In this way, a hydroentangled fiber web was formed. Conditions for the hydroentangling were as follows:

1. Shower: 0.1 MPa onto the surface A
2. 7.0 MPa onto the surface A from a nozzle plate having a nozzle diameter of 0.13 mm, and a nozzle pitch of 0.6 mm
3. 7.0 MPa onto the surface B from a nozzle plate having a nozzle diameter of 0.13 mm, and a nozzle pitch of 0.6 mm Next, the hydroentangled fiber web was dried at 100° C. Thereafter, while the web was overfed in the machine direction without being regulated in the cross direction, the web was transported on a conveyer. This hydroentangled fiber web, while being transported, was subjected to heating treatment at a temperature of 140° C. with a hot air dryer. In this way, the latent crimpable fibers were crimped to form highly crimped fibers. At the time of the formation, the area of the hydroentangled fiber web was contracted by 50% in total in the machine direction and the cross direction to form a contracted fiber web having a mass per unit area of 96 g/m$^2$.

This stable-state contracted fiber web, which no longer retained heat, was passed into the gap of an embossing machine (linear pressure: 20 kg/cm) composed of a smoothing roll made of a heat resistant resin (component: polyamide, Shore D hardness: 83) and an embossing roll (temperature: 100° C.) made of a metal to manufacture a nonwoven fabric partially having compressed regions. In the compressed regions of this nonwoven fabric, no fibers were melted and bonded to each other. The compressed regions were the same as in Example 1.

Comparative Example 1

A nonwoven fabric for comparison was manufactured in the same way as in Example 1 except that fibers of a cross-laid web (mass per unit area: 55 g/m$^2$) were entangled with each other at a needle density of 60 per square centimeter to form a needle-punched fiber web, the temperature of the hot air dryer was set to 195° C. when the latent crimpable fibers were crimped to form the highly crimped fibers, and the area of the needle-punched fiber web was contracted by 45% in total in the machine direction and the cross direction. In the compressed regions of this nonwoven fabric, no fibers were melted and bonded to each other.

Comparative Example 2

A nonwoven fabric for comparison was manufactured in the same way as in Example 1 except that the hydroentangling conditions were changed as described below, the temperature of the hot air dryer was set to 190° C. when the latent crimpable fibers were crimped to form the highly crimped fibers, and the area of the hydroentangled fiber web was contracted by 47% in total in the machine direction and the cross direction. In the compressed regions of this nonwoven fabric, no fibers were melted and bonded to each other.

1. Shower: 0.1 MPa onto the surface A
2. 4.0 MPa onto the surface A from a nozzle plate having a nozzle diameter of 0.13 mm, and a nozzle pitch of 0.6 mm 3. 4.0 MPa onto the surface B from a nozzle plate having a nozzle diameter of 0.13 mm, and a nozzle pitch of 0.6 mm Comparative Example 3

A nonwoven fabric for comparison was manufactured in the same way as in Example 1 except that the hydroentangling conditions were changed as described below, the temperature of the hot air dryer was set to 165° C. when the latent crimpable fibers were crimped to form the highly crimped fibers, and the area of the hydroentangled fiber web was contracted by 24%. In the compressed regions of this nonwoven fabric, no fibers were melted and bonded to each other.

1. Shower: 0.1 MPa onto the surface A
2. 7.0 MPa onto the surface A from a nozzle plate having a nozzle diameter of 0.13 mm, and a nozzle pitch of 0.6 mm Comparative Example 4

A nonwoven fabric for comparison was manufactured in the same way as in Example 1 except that the hydroentangling conditions were changed as described below, the temperature of the hot air dryer was set to 140° C. when the latent crimpable fibers were crimped to form the highly crimped fibers, and the area of the hydroentangled fiber web was contracted by 15% in total in the machine direction and the cross direction. In the compressed regions of this nonwoven fabric, no fibers were melted and bonded to each other.

1. Shower: 0.1 MPa onto the surface A
2. 5.5 MPa onto the surface A from a nozzle plate having a nozzle diameter of 0.13 mm, and a nozzle pitch of 0.6 mm
3. 5.5 MPa onto the surface B from a nozzle plate having a nozzle diameter of 0.13 mm, and a nozzle pitch of 0.6 mm Comparative Example 5

A nonwoven fabric for comparison was manufactured in the same way as in Comparative Example 1 except that fibers of a cross-laid web (mass per unit area: 55 g/m$^2$) were entangled with each other at a needle density of 50 per square centimeter to form a needle-punched fiber web, and the area of the needle-punched fiber web was contracted by 55% in total in the machine direction and the cross direction. In the compressed regions of this nonwoven fabric, no fibers were melted and bonded to each other.

(Evaluations of Various Physical Properties)

The tensile strength, the extensibility percentage, the 50% modulus strength, the recovery ratio when the nonwoven fabric was extended by 50%, and the average texture index of each of the nonwoven fabrics were measured in the above-mentioned ways. The results are as shown in Tables 1 and 2.

(Evaluation of Distinctness of Compressed Regions)

The distinctness of the compressed regions was evaluated in accordance with a judging criterion described below. The results are as shown in Tables 1 and 2.

Each of the nonwoven fabrics was first cut into a specimen in the form of a rectangle having a length of 50 cm in the machine direction and a length of 70 cm in the cross direction. Next, each of the specimens was arranged on a white piece of paper arranging the cross direction horizontal, and the machine direction vertical. Thereafter, the evaluating piece was held vertical. Under a room fluorescent lamp, each of the specimens was checked with the naked eye from a position 50 cm apart upward from a point 50 cm apart in an orthogonal direction from the evaluating piece. The specimen was judged in accordance with the following criterion:

(Judging Criterion)

A (Excellent): The compressed regions were distinct so that all the characters were recognizable.

B (Good): The compressed regions were distinct, but the characters were partially difficult to recognize.

C (Fair): Many of the compressed regions were indistinct, and parts of the characters were difficult to recognize.

F (Failure): The compressed regions were indistinct so that the characters were difficult to recognize.

(Evaluation of Distinctness after Rubbing)

An appearance retention tester (bottom surface area of its sample holder: 20 cm$^2$; pressing load: 3.23 N) prescribed in JIS L1076: 2006 (Pilling Test Method for Textile and Knitting) was used to rub the surface having the compressed regions of each of the nonwoven fabrics 10 times. Thereafter, each of the nonwoven fabrics was evaluated in the same way as in the item "Evaluation of Distinctness of Compressed Regions". The results are as shown in Tables 1 and 2.

TABLE 1

| Examples | | 1 | 2 | 3 | 4 |
|---|---|---|---|---|---|
| (a) | | 5.5 | 4.0 | 4.0 | 7.0 |
| (b) | | 5.5 | 5.5 | 5.0 | 7.0 |
| (c) | | 40 | 35 | 45 | 50 |
| (d) | | | | | |
| (e) | MD | 122.0 | 70.0 | 56.0 | 66.0 |
| | CD | 54.0 | 37.0 | 28.0 | 40.0 |
| (f) | | | | | |
| (g) | | 100 | 67 | 86 | 96 |
| (h) | | 0.73 | 0.60 | 0.83 | 0.88 |
| (i) | MD | 122.0 | 70.0 | 55.5 | 66.0 |
| | CD | 54.0 | 37.0 | 27.6 | 40.0 |
| (j) | MD | 126 | 134 | 135 | 161 |
| | CD | 203 | 183 | 206 | 183 |
| (k) | MD | 17.9 | 10.6 | 7.8 | 9.4 |
| | CD | 3.7 | 2.7 | 2.0 | 2.6 |
| (l) | MD | 48 | 49 | 60 | 52 |
| | CD | 65 | 65 | 61 | 57 |
| (m) | | 0.34 | 0.50 | 0.36 | 0.37 |
| (n) | | A | B | B | B |
| (o) | | B | C | C | B |

(a) Surface A (MPa)
(b) Surface B (MPa)
(c) Area shrinkage (%)
(d) Physical properties of contracted fiber web
(e) Tensile strength (N/50-mm-width)
(f) Physical properties of nonwoven fabric
(g) Mass per unit area (g/m )
(h) Thickness (mm)
(i) Tensile strength (N/50-mm-width)
(j) Extensibility percentage (%)
(k) 50% Modulus strength (N/50-mm-width)
(l) Recovery ratio (%) at 50%-extension
(m) Average texture factor
(n) Distinctness
(o) Distinctness after rubbing
(MD) Machine direction
(CD) Cross direction

TABLE 2

| Comparative Examples | 1 | 2 | 3 | 4 | 5 |
|---|---|---|---|---|---|
| (a) | — | 4.0 | 7.0 | 5.5 | — |
| (b) | — | 4.0 | — | 5.5 | — |
| (c) | 45 | 47 | 24 | 15 | 55 |
| (d) | | | | | |

TABLE 2-continued

| Comparative Examples | | 1 | 2 | 3 | 4 | 5 |
|---|---|---|---|---|---|---|
| (e) | MD | 26 | 41 | 47 | 54 | 21 |
| | CD | 13 | 21 | 23 | 20 | 14 |
| (f) | | | | | | |
| (g) | | 94 | 91 | 89 | 70 | 115 |
| (h) | | 0.95 | 0.88 | 0.92 | 0.80 | 0.98 |
| (i) | MD | 26.3 | 40.5 | 47.0 | 53.7 | 20.6 |
| | CD | 12.9 | 20.5 | 23.2 | 19.6 | 14.0 |
| (j) | MD | 125 | 138 | 132 | 98 | 138 |
| | CD | 216 | 218 | 158 | 126 | 226 |
| (k) | MD | 7.4 | 8.6 | 12.5 | 13.5 | 7.4 |
| | CD | 1.0 | 1.8 | 2.8 | 2.4 | 1.5 |
| (l) | MD | 57 | 68 | 38 | 35 | 65 |
| | CD | 72 | 67 | 47 | 42 | 76 |
| (m) | | 0.57 | 0.33 | 0.47 | 0.51 | 0.57 |
| (n) | | F | B | B | B | C |
| (o) | | F | F | F | F | F |

The following was found from Tables 1 and 2:

1. According to the comparison of Examples 1 to 4 with Comparative Examples 1 to 5, when the tensile strength is 25 N/5-cm-width or more in both the machine direction and the cross direction, the distinctness of the compressed regions is satisfactory, and the distinctness can be retained even when the regions are rubbed.
2. According to the comparison of Example 1 with Examples 2 and 3, when the tensile strength is 40 N/5-cm-width or more in both the machine direction and the cross direction, the distinctness of the compressed regions is more satisfactory, and the distinctness can be retained even when the regions are rubbed.
3. According to Comparative Example 1, it is difficult to manufacture a nonwoven fabric satisfactory in tensile strength in both the machine direction and the cross direction by the needle punching method. As a result, a nonwoven fabric having distinct compressed regions is not easily manufactured.
4. According to the comparison of Examples 2 and 3 with Comparative Example 2, unless a hydroentangled fiber web is formed by the action of a water jet having a pressure of 5 MPa or more, it is difficult to bring the tensile strength in both the machine direction and the cross direction to 25 N/5-cm-width or more. As a result, it is difficult to manufacture a nonwoven fabric having compressed regions giving a distinctness that can be retained even when the fabric is rubbed.
5. According to the comparison of Examples 2 and 3 with Comparative Examples 3 and 4, even when a water jet having a pressure of 5 MPa or more is caused to act onto a fiber web, it is difficult to manufacture a nonwoven fabric having a tensile strength of 25 N/5-cm-width or more in both the machine direction and the cross direction unless the entangled fiber web is contracted by 30% or more. As a result, it is difficult to manufacture a nonwoven fabric having compressed regions giving a distinctness that can be retained even when the fabric is rubbed.

Example 5

The following fibers were used in a proportion of 100 mass %: side-by-side type latent crimpable fibers (fineness: 1.3 dtex; and fiber length: 44 mm) composed of a polyester (melting point: 250° C.) and a low-melting-point polyester (melting point: 230° C.). A carding machine was used to open the fibers, and a parallel web (mass per unit area: 40 g/m$^2$) was formed. Thereafter, a twill weave net support made of polyester and having a mesh of 90 was used to transport the web while the fibers were entangled with each other by a water jet. In this way, a hydroentangled fiber web was formed. Conditions for the hydroentangling were as follows:

1. Shower: 0.1 MPa onto the surface A
2. 5.0 MPa onto the surface A from a nozzle plate having a nozzle diameter of 0.13 mm, and a nozzle pitch of 0.6 mm
3. 6.0 MPa onto the surface B from a nozzle plate having a nozzle diameter of 0.13 mm, and a nozzle pitch of 0.6 mm Next, the hydroentangled fiber web was dried at 100° C. Thereafter, while the web was overfed in the machine direction without being regulated in the cross direction, the web was transported on a conveyer. This hydroentangled fiber web, while being transported, was subjected to heating treatment at a temperature of 180° C. with a hot air dryer. In this way, the latent crimpable fibers were crimped to form highly crimped fibers. At the time of the formation, the area of the hydroentangled fiber web was contracted by 55% in total in the machine direction and the cross direction to form a contracted fiber web having a mass per unit area of 93 g/m$^2$.

This stable-state contracted fiber web, which was no longer heated, was supplied into the gap of an embossing machine (linear pressure: 20 kg/cm) composed of a smoothing roll made of a heat resistant resin (component: polyamide, Shore D hardness: 83) and an embossing roll (temperature: 160° C.) made of a metal to manufacture a nonwoven fabric partially having compressed regions. In the compressed regions of this nonwoven fabric, no fibers were melted and bonded to each other. The compressed regions were the same as in Example 1.

Example 6

The following fibers were used in a proportion of 100 mass %: side-by-side type latent crimpable fibers (fineness: 1.7 dtex; and fiber length: 51 mm) composed of a polyester (melting point: 250° C.) and a low-melting-point polyester (melting point: 230° C.). A carding machine was used to open the fibers, and a parallel web (mass per unit area: 23 g/m$^2$) was formed. Another parallel web formed in the same way was used to form a cross-laid web (mass per unit area: 22 g/m$^2$) using a cross lapper. The parallel web and the cross-laid web were laminated, and a twill weave net support made of polyester and having a mesh of 90 was used to transport the webs while the fibers were entangled with each other by a water jet. In this way, a hydroentangled fiber web was formed. Conditions for the hydroentangling were as follows:

1. Shower: 0.1 MPa onto the surface A
2. 6.0 MPa onto the surface A from a nozzle plate having a nozzle diameter of 0.13 mm, and a nozzle pitch of 0.6 mm
3. 7.0 MPa onto the surface B from a nozzle plate having a nozzle diameter of 0.13 mm, and a nozzle pitch of 0.6 mm Next, the hydroentangled fiber web was dried at 100° C. Thereafter, while the web was overfed in the machine direction without being regulated in the cross direction, the web was transported on a conveyer. This hydroentangled fiber web, while being transported, was subjected to heating treatment at a temperature of 185° C. with a hot air dryer. In this way, the latent crimpable fibers were crimped to form highly crimped fibers. At the time of the formation, the area of the hydroentangled fiber web was contracted by 45% in total in the machine direction and the cross direction to form a contracted fiber web having a mass per unit area of 80 g/m$^2$.

This stable-state contracted fiber web, which was no longer heated, was treated in the same way as in Example 5 to manufacture a nonwoven fabric partially having the same compressed regions as those in Example 1. In the compressed regions of this nonwoven fabric, no fibers were melted and bonded to each other.

Example 7

The following fibers were used in a proportion of 100 mass %: side-by-side type latent crimpable fibers (fineness: 2.2 dtex; and fiber length: 51 mm) composed of a polyester (melting point: 250° C.) and a low-melting-point polyester (melting point: 230° C.). A carding machine was used to open the fibers, and a parallel web (mass per unit area: 30 g/m$^2$) was formed. Another parallel web formed in the same way was used to form a cross-laid web (mass per unit area: 30 g/m$^2$) using a cross lapper. The parallel web and the cross-laid web were laminated, and a twill weave net support made of polyester and having a mesh of 90 was used to transport the webs while the fibers were entangled with each other by a water jet. In this way, a hydroentangled fiber web was formed. Conditions for the hydroentangling were as follows:

1. Shower: 0.1 MPa onto the surface A
2. 5.0 MPa onto the surface A from a nozzle plate having a nozzle diameter of 0.13 mm, and a nozzle pitch of 0.6 mm
3. 5.5 MPa onto the surface B from a nozzle plate having a nozzle diameter of 0.13 mm, and a nozzle pitch of 0.6 mm Next, the hydroentangled fiber web was dried at 100° C. Thereafter, while the web was overfed in the machine direction without being regulated in the cross direction, the web was transported on a conveyer. This hydroentangled fiber web, while being transported, was subjected to heating treatment at a temperature of 180° C. with a hot air dryer. In this way, the latent crimpable fibers were crimped to form highly crimped fibers. At the time of the formation, the area of the hydroentangled fiber web was contracted by 40% in total in the machine direction and the cross direction to form a contracted fiber web having a mass per unit area of 100 g/m$^2$.

This stable-state contracted fiber web, which was no longer heated, was treated in the same way as in Example 5 to manufacture a nonwoven fabric partially having the same compressed regions as those in Example 1. In the compressed regions of this nonwoven fabric, no fibers were melted and bonded to each other.

Example 8

The following fibers were used in a proportion of 100 mass %: side-by-side type latent crimpable fibers (fineness: 2.2 dtex; and fiber length: 51 mm) composed of a polyester (melting point: 250° C.) and a low-melting-point polyester (melting point: 230° C.). A carding machine was used to open the fibers, and a parallel web (mass per unit area: 28 g/m$^2$) was formed. Another parallel web formed in the same way was used to form a cross-laid web (mass per unit area: 27 g/m$^2$) using a cross lapper. The parallel web and the cross-laid web were laminated, and a twill weave net support made of polyester and having a mesh of 90 was used to transport the webs while the fibers were entangled with each other by a water jet. In this way, a hydroentangled fiber web was formed. Conditions for the hydroentangling were as follows:

1. Shower: 0.1 MPa onto the surface A
2. 6.0 MPa onto the surface A from a nozzle plate having a nozzle diameter of 0.13 mm, and a nozzle pitch of 0.6 mm
3. 6.0 MPa onto the surface B from a nozzle plate having a nozzle diameter of 0.13 mm, and a nozzle pitch of 0.6 mm Next, the hydroentangled fiber web was dried at 100° C. Thereafter, while the web was overfed in the machine direction without being regulated in the cross direction, the web was transported on a conveyer. This hydroentangled fiber web, while being transported, was subjected to heating treatment at a temperature of 180° C. with a hot air dryer. In this way, the latent crimpable fibers were crimped to form highly crimped fibers. At the time of the formation, the area of the hydroentangled fiber web was contracted by 35% totally in the machine direction and the cross direction to form a contracted fiber web having a mass per unit area of 85 g/m$^2$.

This stable-state contracted fiber web, which was no longer heated, was treated in the same way as in Example 5 to manufacture a nonwoven fabric partially having the same compressed regions as those in Example 1. In the compressed regions of this nonwoven fabric, no fibers were melted and bonded to each other.

(Evaluations of Various Physical Properties)

The tensile strength, the extensibility percentage, the 50% modulus strength, the recovery ratio when the nonwoven fabric was extended by 50%, the average texture index, the distinctness of the compressed regions, and the distinctness after rubbing of each of the nonwoven fabrics manufactured in Examples 5 to 8 were measured in the above-mentioned ways. The results are as shown in Table 3.

TABLE 3

| Examples | | 5 | 6 | 7 | 8 |
|---|---|---|---|---|---|
| (a) | | 5.0 | 6.0 | 5.0 | 6.0 |
| (b) | | 6.0 | 7.0 | 5.5 | 6.0 |
| (c) | | 55 | 45 | 40 | 35 |
| (d) | | | | | |
| (e) | MD | 115.0 | 120.1 | 128.5 | 141.5 |
| | CD | 49.1 | 68.6 | 62.9 | 72.3 |
| (f) | | | | | |
| (g) | | 93 | 80 | 100 | 85 |
| (h) | | 0.49 | 0.60 | 0.70 | 0.62 |
| (i) | MD | 115.0 | 120.1 | 128.5 | 141.5 |
| | CD | 49.1 | 68.6 | 62.9 | 72.3 |
| (j) | MD | 150 | 137 | 113 | 114 |
| | CD | 255 | 171 | 165 | 171 |
| (k) | MD | 13.8 | 13.2 | 17.0 | 19.4 |
| | CD | 3.3 | 3.1 | 3.5 | 3.5 |
| (l) | MD | 58 | 45 | 50 | 50 |
| | CD | 62 | 60 | 62 | 59 |
| (m) | | 0.195 | 0.252 | 0.344 | 0.375 |
| (n) | | A | A | A | B |
| (o) | | B | B | B | B |

(a) Surface A (MPa)
(b) Surface B (MPa)
(c) Area shrinkage (%)
(d) Physical properties of contracted fiber web
(e) Tensile strength (N/50-mm-width)
(f) Physical properties of nonwoven fabric
(g) Mass per unit area (g/m$^2$)
(h) Thickness (mm)
(i) Tensile strength (N/50-mm-width)
(j) Extensibility percentage (%)
(k) 50% Modulus strength (N/50-mm-width)
(l) Recovery ratio (%) at 50%-extension
(m) Average texture factor
(n) Distinctness
(o) Distinctness after rubbing
(MD) Machine direction
(CD) Cross direction It was found from the results of Examples 5 and 6 shown in Table 3 that when the fineness of latent crimpable fibers is small, the texture of a nonwoven fabric is improved, and as a result, the distinctness of the compressed regions is improved.

Further, it was found from the results of Examples 1, 7, and 8 that when the tensile strength is 25 N/5-cm-width or more in the machine direction and the cross direction, regardless of the orientation of fibers, it is possible to manufacture a nonwoven fabric having compressed regions in which the distinctness can be retained even when the nonwoven fabric are rubbed.

INDUSTRIAL APPLICABILITY

The nonwoven fabric of the invention is very good in extensibility and stretchability, and further has a distinct compressed region. The nonwoven fabric has such a good abrasion resistance that the distinctness of the compressed region can be retained even after the nonwoven fabric is rubbed. Thus, the nonwoven fabric can be favorably used for an article for which these physical properties are required. The nonwoven fabric can be favorably used as a skin patch base-material onto which an ointment containing a medicinal component is to be applied in order to constitute a medicinal patch for external use, a skin patch base-material onto which a cosmetic gel is to be applied in order to constitute a face pack, or a skin patch base-material into which a lotion is to be impregnated in order to constitute a face pack.

REFERENCE SIGNS LIST

MD: Machine direction

CD: Cross direction $L_{CA}$: Straight line consistent with the central axis of any one of the compressed region units (of a nonwoven fabric)

$L_{MD}$: Straight line parallel to the machine direction of the nonwoven fabric $L_{CD}$: Straight line parallel to the cross direction of the nonwoven fabric $L_{C\text{-}MD}$: Straight line drawn by linking the center of any one of the compressed region units with the center of the compressed region unit nearest to the first compressed region unit in the machine direction of the nonwoven fabric $L_{C\text{-}CD}$: Straight line drawn by linking the center of any one of the compressed region units with the center of the compressed region unit nearest to the first compressed region unit in the cross direction of the nonwoven fabric

The invention claimed is:

1. A method for manufacturing a nonwoven fabric, comprising the steps of:

(1) forming a fiber web made mainly of latent crimpable fibers, wherein the fiber web made mainly of latent crimpable fibers is a fiber web made mainly of latent crimpable fibers made of a combination of polyethylene terephthalate/low-melting-point polyethylene terephthalate, (2) causing a water jet having a pressure of 5.5 MPa or more to act onto the fiber web, thereby forming an entangled fiber web, (3) causing heat to act onto the entangled fiber web, thereby crimping the latent crimpable fibers to convert the fibers to crimped fibers, and contracting, at the time of the conversion, the area of the entangled fiber web by 35% or more in the machine direction and/or the cross direction, thereby forming a contracted fiber web, and (4) once the contracted fiber web has reached a stable-state and no longer retains heat from step (3), embossing the stable-state contracted fiber web that no longer retains heat in such a manner that the fibers are not melted and bonded to each other, thereby forming a nonwoven fabric partially having a compressed region, having a 50% modulus strength of 8 N/5-cm-width or less in the cross direction, and having a tensile strength of 55 N/5-cm-width or more in the machine direction and a tensile strength of 40 N/5-cm-width or more in the cross direction.

2. The method according to claim 1, consisting of steps (1) to (4).

3. The method according to claim 1, wherein the recovery ratio when the nonwoven fabric is extended by 50% is 40% or more in both the machine direction and the cross direction.

* * * * *